US007870944B2

(12) United States Patent
Johnsson

(10) Patent No.: US 7,870,944 B2
(45) Date of Patent: Jan. 18, 2011

(54) DEVICE AND METHOD FOR A CARTONING MACHINE

(75) Inventor: Peter Johnsson, Kalmar (SE)

(73) Assignee: Norden Pac Development AB (SE)

( * ) Notice: Subject to any disclaimer, the term of this patent is extended or adjusted under 35 U.S.C. 154(b) by 877 days.

(21) Appl. No.: 11/667,233

(22) PCT Filed: Nov. 9, 2005

(86) PCT No.: PCT/SE2005/001677

§ 371 (c)(1),
(2), (4) Date: May 8, 2007

(87) PCT Pub. No.: WO2006/052191

PCT Pub. Date: May 18, 2006

(65) Prior Publication Data

US 2008/0016823 A1 Jan. 24, 2008

(30) Foreign Application Priority Data

Nov. 10, 2004 (SE) ..... 0402738

(51) Int. Cl.
*B65B 61/20* (2006.01)

(52) U.S. Cl. ..... 198/457.01; 198/461.1; 198/473.1; 198/476.1; 198/480.1

(58) Field of Classification Search ..... 198/457.01, 198/457.07, 459.8, 461.1, 469.1, 473.1, 476.1, 198/478.1, 479.1, 480.1
See application file for complete search history.

(56) References Cited

U.S. PATENT DOCUMENTS 3,523,400 A * 8/1970 Daily ..... 53/117
4,350,002 A 9/1982 Focke
4,351,679 A * 9/1982 Dreher ..... 156/70
5,052,542 A * 10/1991 Wipf ..... 198/370.08
5,157,896 A * 10/1992 Tisma ..... 53/252

(Continued)

FOREIGN PATENT DOCUMENTS

CA 2457764 4/2003

(Continued)

OTHER PUBLICATIONS

"International Search Report for corresponding PCT Application No. PCT/SE2005/001677", (Feb. 2, 2006), 4 pgs.

*Primary Examiner*—Douglas A Hess
(74) *Attorney, Agent, or Firm*—Schwegman, Lundberg & Woessner, P.A.

(57) ABSTRACT

Embodiments include a method or a device for a cartoning machine for transferring a leaflet from a first transportation device to a leaflet holder in a second transportation device. Embodiments include a transferring device which is arranged to straighten up and position the leaflets in such a way that the leaflet holders can take hold of the leaflets. The transferring device has a base surface with one or more carriers placed in a line at right angels to the direction of transportation, so that the leaflet, as a result of being able to slide against the base surface, is pressed back against the carriers as a result of air resistance friction against an adjacent cover plate and/or centripetal forces. The base surface of the transferring device is preferably provided with several lines of carriers which are adjusted to match the distance between the leaflet holders on the second transportation device.

22 Claims, 7 Drawing Sheets

U.S. PATENT DOCUMENTS 5,310,041 A * 5/1994 Draghetti ..... 198/412
5,529,167 A * 6/1996 Gabriele ..... 198/457.01
5,540,320 A * 7/1996 Sarto et al. ..... 198/473.1
5,695,041 A * 12/1997 Kouda et al. ..... 198/459.2
6,016,638 A * 1/2000 Bernard et al. ..... 53/117
6,139,009 A * 10/2000 Eckert ..... 271/187
6,354,060 B1 3/2002 Plüschow et al.
6,536,194 B2 * 3/2003 Minardi ..... 53/564
6,786,024 B2 * 9/2004 Sichera et al. ..... 53/445
7,036,655 B2 * 5/2006 Schafer ..... 198/459.2
2001/0000286 A1 4/2001 Lewis et al.

FOREIGN PATENT DOCUMENTS

EP 0957028 A1 11/1999

* cited by examiner

DEVICE AND METHOD FOR A CARTONING MACHINE

RELATED APPLICATIONS

This application is a nationalization under 35 U.S.C. 371 of PCT/SE2005/001677, filed Nov. 9, 2005 and published as WO 2006/052191 A1, on May 18, 2006, which claimed priority under 35 U.S.C. 119 to Sweden Application No. 0402738.9, filed Nov. 10, 2004; which applications and publication are incorporated herein by reference and made a part hereof.

TECHNICAL FIELD

The invention relates in general to a method and a device for a cartoning machine for transferring a leaflet, for example in the form of a folded sheet of paper, coupon, instruction brochure or the like, from a first transportation device to a leaflet holder placed on a second transportation device. The invention is primarily suited for products for the convenience goods trade, such as personal care products or food products, or products for the pharmaceutical industry, such as medicaments, vitamins or minerals, which are to be packaged in a carton together with a leaflet.

BACKGROUND ART

Some form of written information accompanies most products that are manufactured and sold today. In some cases the amount of information is limited and it can suffice to provide the carton with text. There are, however, several cases when, for one reason or another, it is desirable to enclose a separate information sheet or the like. These reasons can, for example, be that there is not sufficient space on the carton, that it is not appropriate to have the written information on the product's carton or that it is a question of a coupon that is intended to be sent off. The information can be of widely varying types and can, for example, be instructions for use of a product, content declarations, dosage instructions, advertising or warning texts. In some cases there is a large amount of information that needs to be printed out and accompany the product, for example when it is a question of a pharmaceutical preparation. In this case, it is normally a question of relatively small cartons and the instructions for use that accompany the product often contain a relatively large amount of text that, in addition, must sometimes be printed in several languages.

A common way of enclosing this information with the product is currently to put a leaflet in the carton at the same time as the product, normally contained in a pot or tube, is packed into the carton. The leaflet is in most cases a folded sheet of paper which, after folding, is designed to fit in the carton. U.S. Pat. No. 6,354,060 describes a common method for inserting the leaflet into the carton together with the product (a tube or pot). The carton is transported on a conveyor belt which, at least for certain parts, runs parallel with another conveyor belt which transports the product. These two conveyor belts are synchronized in such a way that the product can be inserted into the open carton by an inserting mechanism that pushes the product into the carton in a direction at right angles to the direction of transportation. Between the conveyor belt for the carton and the conveyor belt for the product there is a leaflet holder supported on a chain which is synchronized with the other two conveyor belts and positions a leaflet that is held in the leaflet holder between the product and the carton. When the product, the leaflet and the carton are in a synchronized position, the inserting mechanism pushes the product into the carton and together with this pushes the leaflet into the carton, while at the same time the leaflet is folded.

A current problem with this method is of synchronizing the process and of placing the leaflet in position to be pushed into the carton in a reliable way. A precondition for succeeding with this is that the leaflet must be placed correctly in the right position in the leaflet holder. Leaflets can be relatively difficult to handle, as they normally consist of a folded sheet of thin paper, which is easily disturbed and moved out of position during transportation or while transferring it between the various transportation devices in the cartoning machine, which is particularly difficult at the high speeds of production that are required in modern machines. If the leaflet is askew in the holder, it can result in the leaflet being crumpled or being torn when it is inserted into the carton together with the product, which can result in an expensive stoppage, repackaging of products or rejection of the packaged product.

CA 2 457 764 describes a device for transferring a leaflet from a folding machine to a leaflet holder. The machine sets and adjusts the feeding forward of the leaflets depending upon the size of the leaflet and positions the leaflet in relation to the leaflet holder for delivering the leaflet to the holders. After the speed and position of the leaflet feeder and the conveyor belt with the leaflet holders have been synchronized, the machine operates with these settings. In spite of the fact that the machine is thus set to work correctly for a particular format, there is, however, no guarantee that it will work correctly if the leaflets are not fed correctly out of the folding machine. In the example described and in most cases, the feed device from this machine consists of a conveyor belt. With such a feed device, it can be the case that a leaflet is not fed out the same way each time but can end up askew on the conveyor belt. In CA 2 457 764 there is nothing described that can compensate for such a fault. Nor is it possible to compensate during transportation for a more systematic fault if the feed device consistently feeds out leaflets from the folding machine askew. The fact that a leaflet has been fed out from the folding machine askew will result in the leaflet being placed askew in the holder.

There is thus still a need for an improved method and device for placing a leaflet correctly in a leaflet holder in a cartoning machine and thereby being able to insert it in a carton in a reliable way.

DISCLOSURE OF INVENTION

The invention relates to a cartoning machine for transferring a leaflet from a first transportation device to a leaflet holder comprised in a second transportation device. The invention is characterized in that the device comprises a transferring device which is arranged to transfer the said leaflet from the first transportation device to the second transportation device. The transferring device has a base surface and at least one carrier arranged to convey the leaflet. The transferring device and its carrier are designed in such a way that the leaflet, while it is being conveyed, rests against the base surface of the transportation device and is conveyed by the transportation device by making contact with one or more carriers. The transportation device is adapted to suit the leaflets so that, while they are being conveyed, these make contact with a carrier on both sides of the centre line of the breadth of the leaflet in a direction at right angles to the direction of transportation. As the leaflets are not held fixed in the device, they are able to slide on the base surface, while they are being conveyed, and arrange themselves so that they are in contact with the carrier or carriers. The arrangement of the leaflet in contact with the carriers will take place as a result of them being pushed back against the carriers as a result of the air resistance that arises when the leaflet is conveyed by the transferring unit. Additionally, in order to ensure that the leaflet is arranged correctly on the carriers, the transferring unit can be provided with an outer casing that is arranged close to the distal end of the carrier. While the leaflet is being conveyed, it is thus pushed back towards the carriers by the friction that arises between the leaflet and the outer casing.

If it is askew, the leaflet is thus straightened up and aligns itself with one side of the leaflet lying along the carriers. The leaflet is positioned in the transferring device in such a way that the leaflet holders arranged on the second transportation device, which is coordinated with the transferring device, can take hold of the leaflet while the leaflet is being conveyed by the transferring device. The delivery from the delivery device to the leaflet holders is advantageously carried out while the delivery device and the second transportation device are running parallel. By synchronizing the leaflet holders with the carriers on the transferring device, a reliable delivery of the leaflet can be achieved. An advantage of this arrangement in comparison with previously-known technology is that the section during which delivery can be carried out is relatively long, which makes it possible to carry out the delivery at a high speed. In the arrangement that is shown in CA 2 457 764 a higher level of precision is required, which makes it more difficult to operate at high speeds, for synchronizing the leaflet holder with the conveyor belt from the folding machine in such a way that the leaflet holder takes hold of the leaflet at precisely the right moment. If the leaflet holder takes hold too early, the leaflet will be drawn between the conveyor belt and the holder and accordingly placed askew in the holder. If the holder takes hold too late, the leaflet will be askew as K is completely unsupported when it leaves the conveyor belt and the holder takes hold of it.

The transferring device according to the invention is provided with carriers. These consist of profiles which have a base attached to the transferring device and project from the base surface of the transferring device. According to an embodiment, the profile of the carriers has a base that projects essentially at right angles from the base surface of the transferring device and they are provided with a lug projecting essentially at right angles from the base in the direction of transportation. In another embodiment, the profile of the carriers has a base that projects from the base surface of the transferring device, with an acute angle between the base of the profile and the base surface of the transferring device in the direction of transportation.

It is also possible for the profiles to have moving parts, for example for the lug to be hinged in relation to the base or for it to be able to be moved in the longitudinal direction of the base, so that the lug can be adapted to different thicknesses of leaflets, or for the lug to be able to unfolded, folded away or moved along the length of the base during operation, depending upon the phase of the carriers during the transferring operation. These phases can, for example, be receiving the leaflet, conveying the leaflet, holding the leaflet securely in the leaflet holders or delivering the leaflet.

The carriers are to be designed in such a way that they can convey the leaflet and can also straighten it up. The bases of the carriers are thus arranged so that they form a line on the transferring device that is at right angles to the direction of transportation. This line can consist of a single carrier with a base that extends across the base surface of the transferring device or a plurality of carriers that are positioned in such a way that they form a straight line at right angles to the direction of transportation. The transferring device is preferably provided with several individual carriers or a group of carriers positioned on the transferring device in such a way that the bases of the carriers form a plurality of straight lines at right angles to the direction of transportation and are positioned a particular distance apart. The distance between these lines is usually equidistant and is adjusted to match the distance between the leaflet holders on the second conveyor belt. These distances are usually the same length so that the transferring device and the second transportation device can be synchronized in such a way that the leaflet holders run alongside the carriers for the section where these devices run parallel and run at the same speed. The transferring device can either be designed in such a way that the carriers are permanently attached to the base surface of the transferring device or in such a way that they can be removed relatively easily and attached in different positions so that the distance between the straight lines that are formed by the carriers can be adjusted.

The function of the carriers is to convey the leaflet when this is in the transferring device. In most cases, their function is also to hold the leaflet in the transferring device so that the leaflet does not slide out, and for this reason, in the embodiments that are described, the carriers have been provided with lugs or are angled. It could, however, be possible that these measures are insufficient or that additional devices are required in order to prevent the leaflet falling out of the transferring device, for example when the leaflet is subjected to strong centripetal forces in association with transportation in the transferring device or when the leaflet travels up and down and there is a danger than it will fall out due to the force of gravity. In these cases, it can be desirable for the transferring device to be provided at least partially with an outer casing that holds the leaflet in the transferring device as a result of the outer casing being arranged close to the distal end of the carriers. When the transferring device comprises a plurality of carriers placed in a line a distance apart, it is possible to use a plurality of cover plates or the like that are positioned between the carriers. In this case, the cover plates can be positioned closer to the base surface of the transferring device, as the cover plates do not need to lie outside the distal end of the carriers. In these cases, it can suffice for the carriers only to consist of a profile that has a base that projects essentially at right angles from the base surface of the transferring device.

In an embodiment, the average speed of the second transportation device is the same as that of the transferring device. In this case, the leaflet holders are synchronized with the carriers so that these run alongside each other for at least a part of the section where the leaflet transportation device and the transferring device run parallel. The most usual way of working is that the speed of the second transportation device and of the transferring device are constant. There can, however, be reasons that make it expedient for the second transportation device and/or the transferring device to be driven at varying speeds by, for example, a servo motor. One reason can be to reduce the speed of both the devices when the leaflet is to be taken up by the transferring device or to increase the speed of the leaflet transportation device and/or reduce the speed of the transferring device when their paths separate and no longer run parallel, in order to prevent the leaflet being knocked by, for example, any of the lugs on the carriers. Directly thereafter, the speeds can be adjusted again so that the leaflet holders and the carriers again run alongside each other where their paths are parallel and are thus ready to transfer a new leaflet. By matching the length of the section where the second transportation device and the transferring device run parallel, the distance in the direction of transportation between the carriers, and the section between the taking up and the delivery of the leaflet by the transferring device, advantages can be obtained by varying the speed of the transferring device for both the taking up and delivery of a leaflet.

The transferring device can have different designs and, according to an embodiment, it consists of a rotating body arranged to rotate in a direction parallel to the direction of transportation of the second transportation device. A concept of the invention is that the leaflet does not need to be rotated before it is taken up by the transferring unit. According to a preferred embodiment, the rotating body consists of a body with a cylindrical outer contour with a circular periphery. The rotating body can, however, have several different geometrical shapes and can, for example, have an oval or a cornered periphery.

When the transferring device consists of a rotating body, it can be advantageous for the second transportation device to have an axis of rotation for a control wheel incorporated therein that is common with the centre of rotation for the rotating body. By matching the diameter of the control wheel to the periphery of the transferring device and synchronizing the leaflet holders with the carriers, a robust system can be achieved that makes possible a reliable transfer of the leaflet to a leaflet holder.

In most cases, it is an advantage to utilize a rotating body as the transferring device, which results in a compact and robust system. There are, however, cases when it can be more advantageous if the transferring device consists of an endless belt, for example a chain, toothed belt or a thin metal tape, that makes it possible to transport the leaflet along for a short distance before it is transferred to the leaflet holder.

According to another variant of the invention, the transferring device consists of two rotating bodies. The first rotating body is arranged to receive the leaflet from the leaflet feed device and to make a first rough adjustment of the leaflet. When the leaflet has been adjusted and straightened up, it is transferred to the second rotating body that holds the leaflet in place while it is transferred to a leaflet holder that takes hold of the leaflet. It is, of course, possible for the transferring device to consist of other units than rotating bodies also in this case, for example for one or both units to consist of an endless belt, for example a chain, toothed belt or a thin metal tape.

The invention also relates to a method for transferring a leaflet from a first transportation device to a leaflet holder comprised in a second transportation device. The leaflet is transported first in the first transportation device and is delivered from this, either directly or via some form of receiving unit, to a transferring device. The transferring device conveys the leaflet by means of carriers arranged to be in contact with the leaflet on both sides of a central line in relation to the breadth of the leaflet in a direction at right angles to the direction of transportation. During the section where the leaflet is conveyed by the transferring device, the leaflet holder can take hold of the leaflet.

The second transportation device and the transferring device are preferably driven at the same speed. In an embodiment, these speeds are constant; in another embodiment, the speed of the second transportation device or of the transferring device varies. With regard to the constructional components in the embodiment shown, it appears to be most advantageous in the present case to let the speed of the transferring device vary. In principle there is, however, no difference in letting the speed of the second transportation device vary instead.

According to an embodiment of the invention, the transferring device is arranged in such a way that the leaflet, while it is being conveyed in the transferring device, rests against the base surface of the transferring device and can slide freely against this. In the present case, the leaflet can align itself in relation to the carriers by lying in contact with these. In the present case, the leaflet is pressed against the carriers by the air resistance that arises during the transportation in the transferring device, by the friction that occurs between the leaflet and an outer casing that is found on the transferring device in certain cases, which outer casing is arranged to extend along at least a part of the path of the transferring device and/or by the acceleration or centrifugal forces that can be expected to arise as a result of curves in the path of the transferring device or momentary changes of speed of the transferring device. It is also possible in the present case, to design the receiving unit, which receives the leaflet from the folding machine, in such a way that this is specially arranged to enable the leaflet to move with the transferring device while the receiving device exerts a suitable frictional force in such a way that the inset is aligned along the carriers before the leaflet has left the receiving unit.

In order to further ensure that the leaflet aligns itself along the carriers, the transferring unit can be provided with an outer casing which is arranged close to the distal ends of the carriers. While it is being conveyed, the leaflet will be pressed back towards the carriers by the friction that arises between the leaflet and the casing.

According to yet another embodiment, the alignment and fine-adjustment of the position of the leaflet is carried out in two stages. In this case, the transferring device comprises two different units, the first unit of which is arranged to carry out a rough adjustment of the leaflet, while the second unit carries out a fine adjustment. For the transferring, the units can, for example, be in the form of rotating bodies (wheels). The first unit is designed with a relatively large space in the direction of transportation between the different carriers in relation to the breadth of the leaflets which thus provides a relatively large tolerance as far as synchronization and positioning are concerned when the leaflets are fed from the feed device. Thus the first unit straightens up the leaflet and is well-synchronized with the second unit that receives the leaflet from the first unit. The leaflet is taken by the second unit while a leaflet holder follows the path of the second unit. The carriers on the second transferring device ensure the position of the leaflet and can ensure that the leaflet is delivered in the correct position to the leaflet holder that takes hold of the leaflet.

By leaflet is meant here, for example, a folded sheet of paper, a coupon, an instruction brochure and other thin material resembling a sheet of paper which can be folded and is intended to accompany a product in a carton. The appearance of the carton is not of significance, but the invention is primarily intended to be used for small card or cardboard cartons intended to be used for pots or tubes containing medicines, toothpaste, personal care products or the like.

BRIEF DESCRIPTION OF DRAWINGS

The invention will be described in greater detail in the following with reference to the figures that are illustrated in the attached drawings. These illustrate.

PREFERRED EMBODIMENTS

Figure 1:
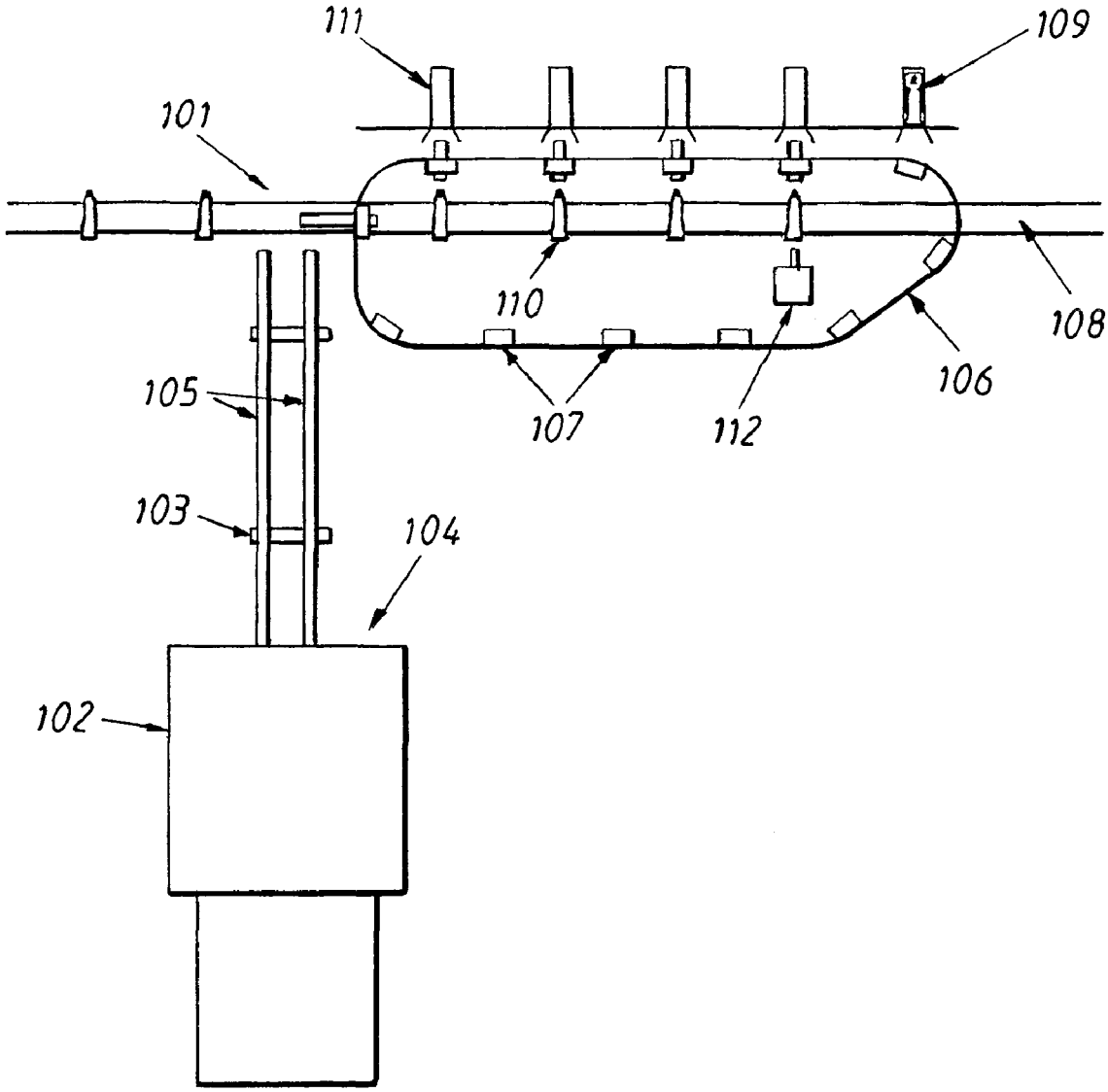
FIG. 1 (PRIOR ART)
FIG. 1: An outline drawing of a cartoning machine with leaflet feed according to previously-known technology.

FIG. 1 shows an outline drawing of a cartoning machine 101 according to previously-known technology. The cartoning machine comprises a folding device 102 for folding a leaflet 103 and a leaflet feed device 104 consisting of two conveyor belts 105 between which the leaflet 103 can be held fast and transported from the folding device 102. For at least a certain section, the feed device 104 runs parallel to a leaflet transportation device 106 that comprises leaflet holders 107. During the section that the feed device 104 and the transportation device 106 run parallel, these are designed in such a way that, during operation of the device, the holder 107 runs alongside a leaflet 103. The holder 107 is designed in such a way that, when the holder 107 runs alongside a leaflet 103, it can take hold of the leaflet 103. At the end of the feed device 104, the leaflet 103 leaves with the conveyor belt 105 and is transported onwards by the transportation device 106. The leaflet 103, held in the holder 107, will be carried forward and will run parallel at the same speed, between a product conveyor belt 108 and a carton conveyor belt 109. These belts are synchronized in such a way that the leaflet holder 107 with the leaflet 103 is positioned on a straight line at right angles to the direction of transportation, with a product 110 on the product conveyor belt 108 and a carton 111 on the carton conveyor belt 109. The carton 111 is open at the end that faces towards the product 110. The cartoning machine 101 also comprises an inserting mechanism 112 that, during the section when the product 110, the carton 111 and the leaflet 103 are positioned in line, is arranged to insert the product 110 in the carton in a direction at right angles to the direction of transportation. During the insertion, the leaflet 103, which is positioned between the product 110 and the carton 111, is released from the leaflet holder 107 and goes into the carton along with the product 110.

Figure 2:
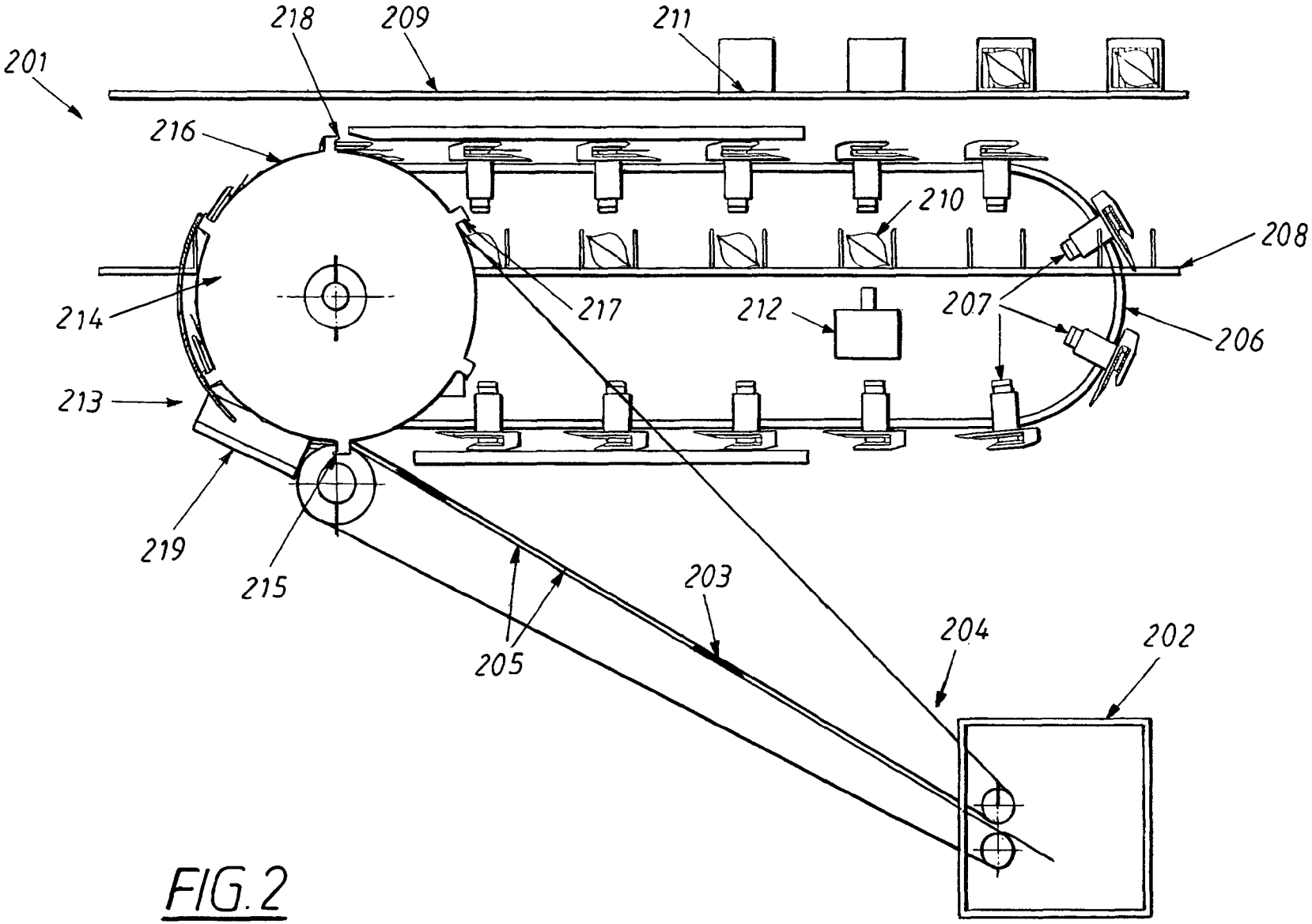
FIG. 2: An outline drawing of a cartoning machine with leaflet delivery according to the invention.

FIG. 2 shows a cartoning machine 201 according to a first embodiment of the invention. As with the cartoning machine shown in FIG. 1, this cartoning machine is provided with a folding device 202 with an associated leaflet feed device 204 with conveyor belt 205 for feeding a leaflet 203 to the leaflet transportation device 206 provided with leaflet holders 207. Unlike the device described in FIG. 1, the cartoning machine 201 according to the invention comprises a transferring device 213 placed at the end of the feed device 204. The transferring device 213 comprises a wheel 214 which is provided with carriers 215 around its periphery. The wheel 214 is arranged in such a way that its carriers 215 are able to take hold of a leaflet 203 when this has reached the end of the leaflet feed device 204 and has left the conveyor belt 205. At the end of the conveyor belt 205 there is a receiving unit 219 that is arranged to receive the leaflet 203 when it leaves the conveyor belt 205. The receiving unit 219 can either be arranged to let the leaflet 203 slide forward in the direction of transportation or can stop it so that the leaflet 203 can then be conveyed by the carriers 215 on the wheel. The carriers 215 are attached to the base surface 216 of the wheel with a base 217 that is at right angles to this. In addition, each carrier 215 is arranged with a lug 218 at its distal end, furthest away from the base surface 216, and projects at right angles from the base 217 in the direction of rotation. The leaflet 203 will lie essentially free against the base surface 216 of the wheel and the bases 217 of the carriers will convey the leaflet 203 in the direction of rotation of the wheel 214. The leaflet 203 is thereby held on the wheel 214 by means of the lugs 218. The wheel 214 will convey the leaflet 203 for a particular section during which the leaflet transportation device 206 at least partially runs parallel to the periphery of the wheel. During the section where the wheel 214 and the transportation device 206 run parallel, during operation of the device, these are arranged in such a way that the holder 207 runs alongside a leaflet 203. The holder 207 is designed to be able to take hold of a leaflet 203 when it runs alongside the leaflet 203. When the leaflet 203 leaves the wheel 214 of the transferring device, it is held fast in the holder 207 and follows the transportation device 206. As in the device described in FIG. 1, the leaflet can be carried further and aligned with a product 210 on a product conveyor belt 208 and a carton 211 on a carton conveyor belt 209 so that the product 210 can be inserted in a carton 211 by means of an inserting mechanism 212 and thereby can take with it into the carton a leaflet 203 that is positioned between the product and the carton.

Figure 3:
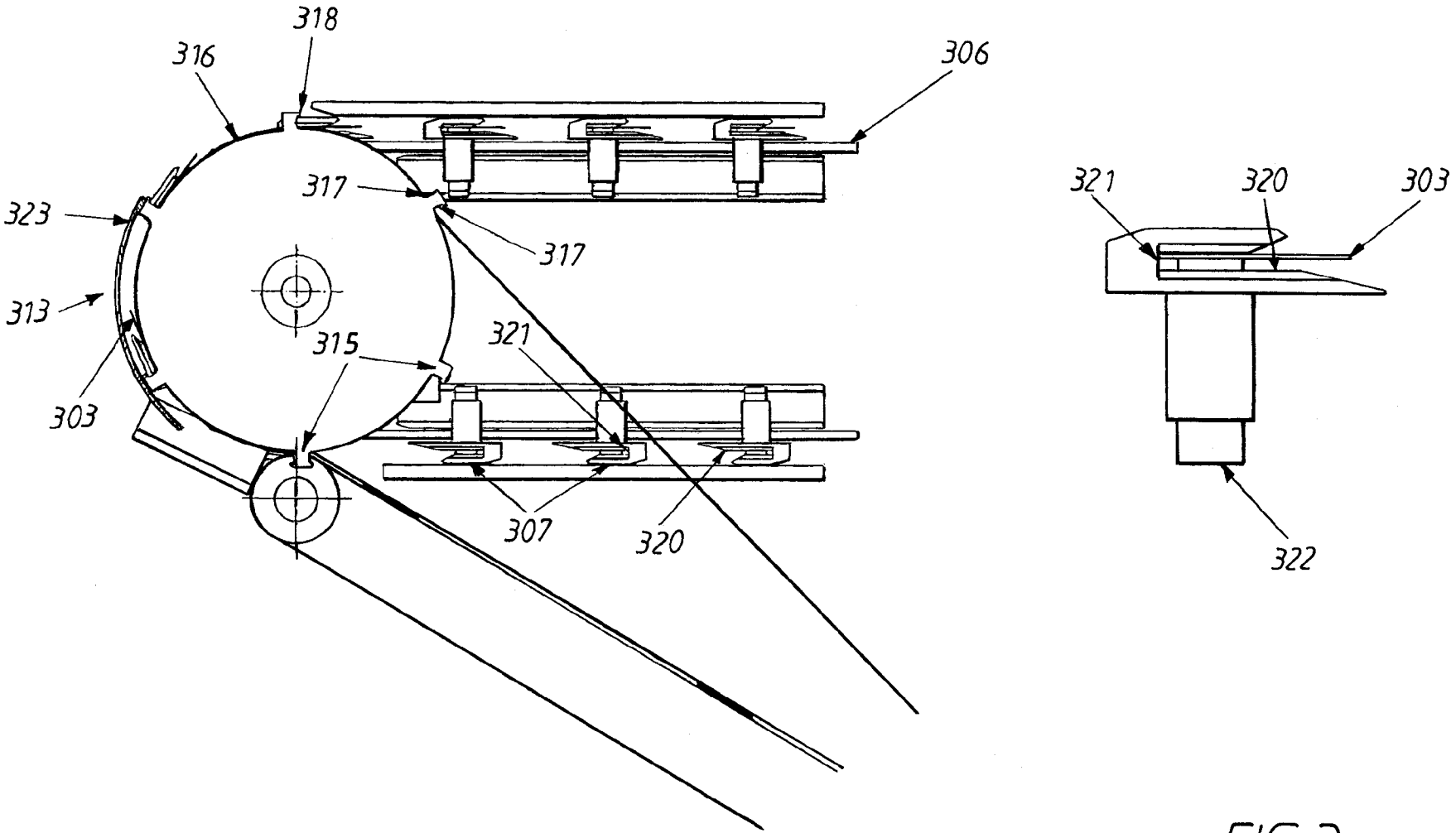
FIG. 3: A side view of the transferring device according to a first embodiment of the invention.

FIG. 3 shows a more detailed drawing of the transferring device 313 according to the first embodiment. This shows clearly how the leaflet transportation device 306 is arranged to run parallel to the wheel 314 for half a revolution so that each leaflet holder 307 runs alongside a carrier 315 for this section. The holders 307 are designed in such a way that their base surface 320, against which the leaflet rests, lies in the same plane as the base surface 316 of the wheel and the stop surface 321 of the holders is in line with the bases 317 of the carriers. In addition, the holders are provided with a fixing device 322 which is activated during the time the leaflet transportation device 306 runs parallel to the wheel and holds the leaflet 303 securely by pressing it against the base surface 320 of the holder. The wheel 314 is also provided with a cover plate 323 that protects the wheel from foreign bodies entering and interfering with the process, which cover plate can also be used in addition to the lugs 318 on the carriers to retain the leaflet against the base surface 316 of the wheel. It is also possible to let the carriers 315 be without lugs and only to use the cover plate 323 to retain the leaflet 303 against the base surface 316 of the wheel.

Figure 4:
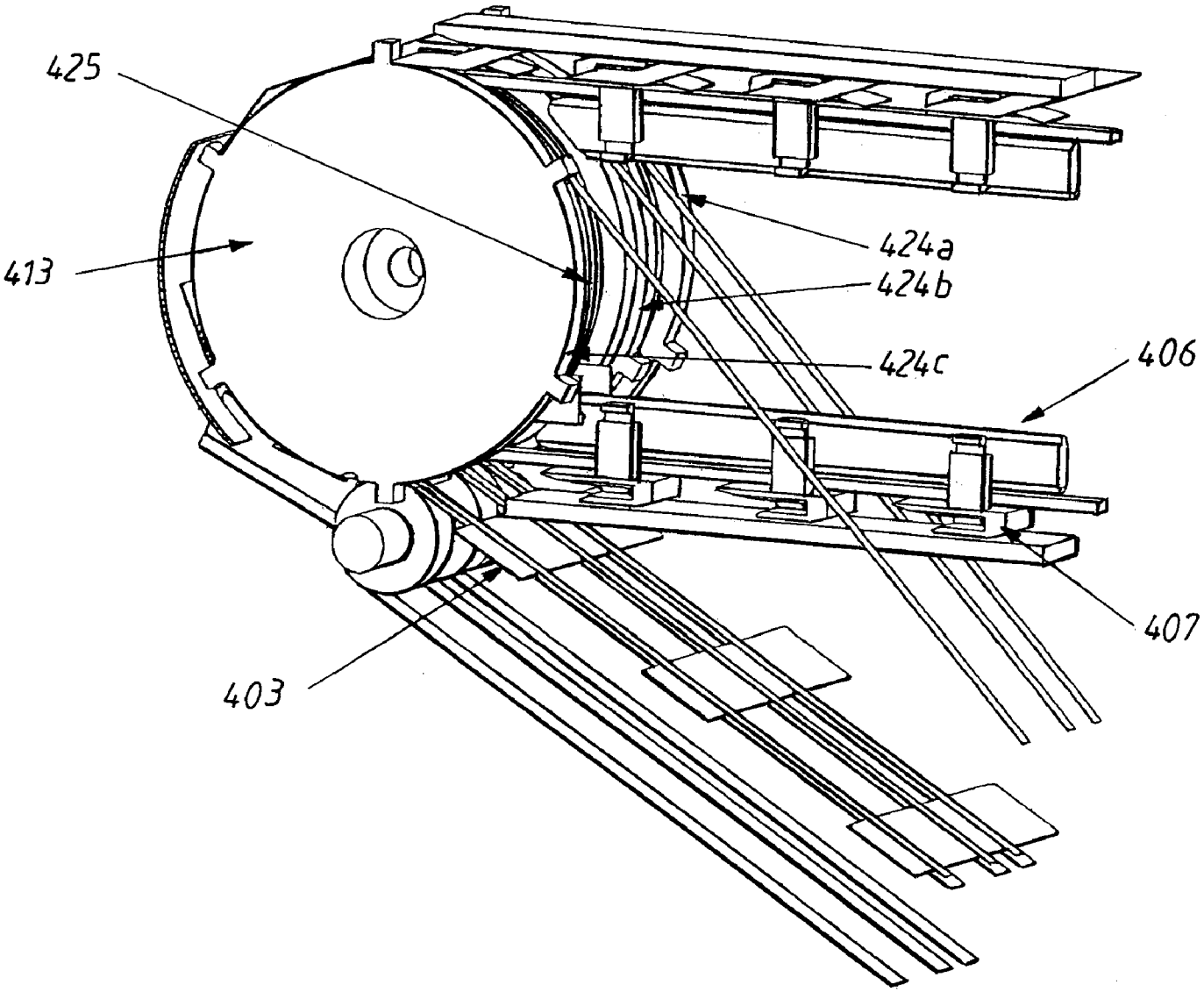
FIG. 4: A perspective view of the transferring device in FIG. 3 viewed obliquely from in front and above.

FIG. 4 shows a perspective view of the transferring device in FIG. 3 viewed obliquely from in front and above. This shows how the transferring wheel 413 is constructed and coordinated with the leaflet transportation device 406. In this case, the wheel 413 comprises three wheel discs 424*a, b, c* with associated carriers 415. A reversing wheel 425 is placed between the wheel disks 424*b, c* with the same centre of rotation as the wheel 413. The reversing wheel 425 can be arranged on the same axis of rotation as the wheel 413 or can be disconnected with a separate axis of rotation. The wheel 413 can be designed as an integrated unit or can be constructed of separate wheel disks 424 that are attached to a common shaft. The wheel disks 424*a, c* are placed at each end of the wheel 413. By placing the wheel disks 424*a, c* relatively far apart, the risk is reduced of the leaflet 403 ending up askew. The breadth, position and number of the wheel disks 424 can be varied depending upon the size of the leaflet 403 and in which position it is desirable that the leaflet holder 407 should take hold of the leaflet. What is important is that the wheel disks 424 are positioned in such a way that there are carriers 415 on each side of a centre line in relation to the breadth of the leaflet in a direction at right angles to the direction of transportation, preferably at least 10% on each side and most preferably at least 25%. The carriers are advantageously positioned in such a way that they are in contact with the leaflet close to the ends of the leaflet. The wheel disks 424*a, b c* are each provided with six carriers 315 that are positioned in six straight lines around the periphery of the wheel 413, parallel to the axis of rotation and spaced equidistantly. The number of carriers on each wheel disk can also be varied depending upon the circumference of the wheel, the speed of the process and which type of synchronization is required.

In the embodiment that is illustrated, the path of the transferring device coincides with the leaflet conveyor belt at the lower part of the wheel and delivery takes place at its upper part. It is, of course, possible to modify this arrangement so that both the paths run parallel for a shorter or longer section depending upon what is required for the process. In addition, it is not laid down specifically where in the section where these devices run parallel the leaflet holder takes hold of the leaflet with the fixing device, but this can be adjusted to suit the process. The fixing device is to be activated sufficiently late for the leaflet to be able to straighten itself up in the transferring device, while at the same time the fixing device must be able to hold the leaflet securely before this has left the transferring device and runs the risk of becoming askew again.

In the embodiment that is shown in FIGS. 2-4, a cylindrical rotating unit is used with a circular circumference. It is also possible to use other geometric shapes for the rotating body, such as oval or cornered.

It is also possible for the transferring device to consist of a belt instead of a rotating body. The belt that is used can be a chain-like construction or a metal strip. In this case, it is possible to let the strip run alongside the leaflet transportation device for a longer section than what is possible when the transferring device consists of a rotating body and where the periphery of the rotating body constitutes a limitation. In addition, a strip construction makes it possible to deliver the leaflet during a section when no acceleration forces act upon the leaflet and it is lying flat in relation to the transferring device. The transferring strip can, for example, have a turning point common with the leaflet transportation device so that the leaflet is put on the transferring device before the strip turns or bends, so that the leaflet is pressed back against the carriers for the section where it is subjected to the force of acceleration and is then transferred to the leaflet holder when the leaflet holder and the leaflet transportation device run parallel and straight ahead.

Within the framework of the invention, there are several different possible ways of varying the respective embodiments. In the examples shown, it has been assumed that the speed of the transferring device and the leaflet conveyor belt are the same and constant during the time that they run parallel. It is also within the concept of the invention that this does not have to be the case, but that it is possible to let any one or both of the product conveyor belt and the transferring device have variable speeds. It is, however, the case that their average speeds are the same.

Figure 5:
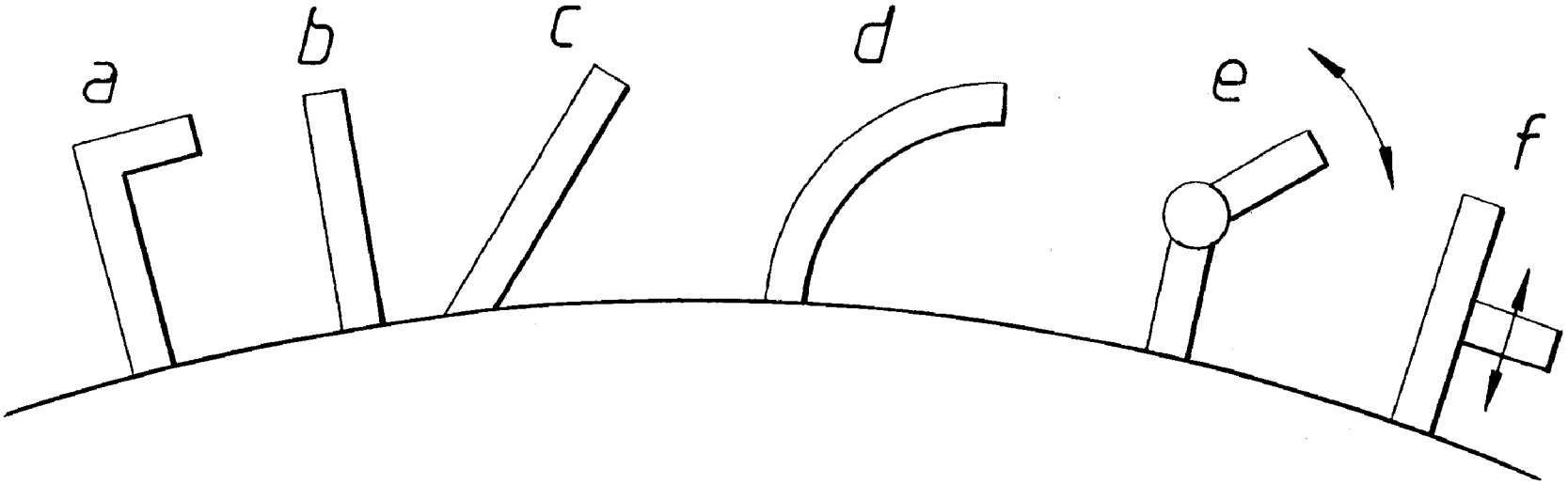
FIG. 5: Different embodiments of carriers.

The design of the carriers can also vary within the framework of the invention. FIG. 5 shows, in addition to the carrier 5*a* shown in FIGS. 2-4, a plurality of possible embodiments of the carrier. FIG. 5*b* shows a carrier in the form of a base projecting at right angles. FIG. 5*c* shows a carrier angled forward in the direction of transportation of rotation, and FIG. 5*d* shows a curved carrier. The carriers that are shown in FIGS. 5*c-d* are designed in such a way that, in the embodiment shown, the base and lug consist of a single continuous part without any obvious distinction. In addition to these shapes, it is possible to have combinations of these or hinged carriers such as shown, for example, in FIG. 5*e*, in which the angle of the lug can be set as required by the lug of the carrier being pivoted, as shown by the arrow in FIG. 5*e*, around a hinge point at the distal end of the base. It is, of course, possible for the carrier to be hinged instead at its point of attachment to the base surface of the transferring device in such a way that its appearance can be varied, for example between appearing as shown in FIGS. 5*b* and 5*c*. FIG. 5*f* shows a carrier with a movable lug that can be adjusted and fixed at a suitable distance from the base surface of the transferring device to suit the thickness of the leaflet. There are thus a plurality of possibilities for designing and arranging the carriers on the base surface of the transferring device. The embodiments shown here are only some examples of the embodiments that are comprised in the concept of the invention.

Figure 6A:
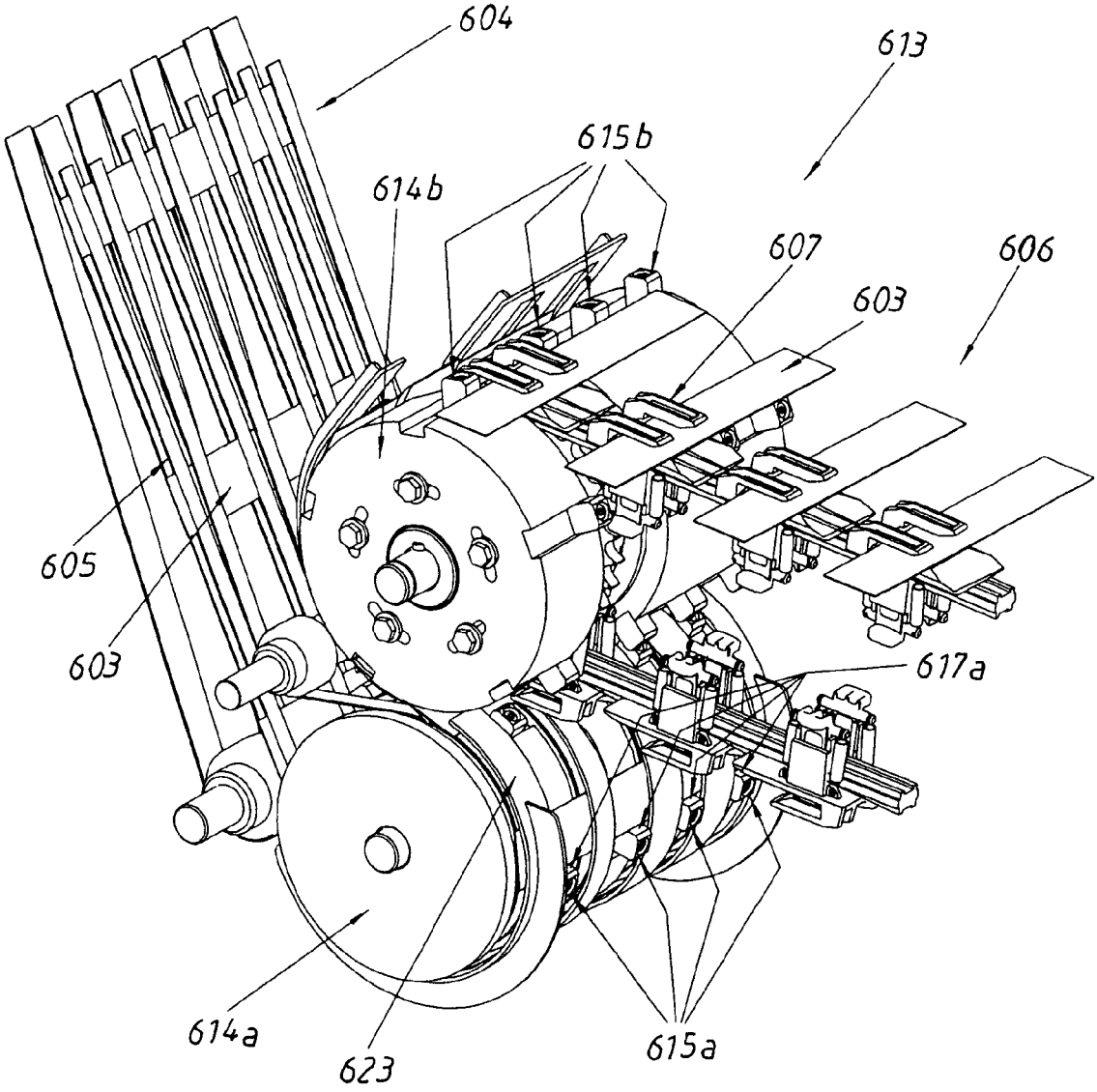
FIG. 6: Shows an embodiment of a transferring device consisting of two transferring units in a perspective view (FIG. 6*a*) and in a side view (FIG. 6*b*).
Figure 6B:
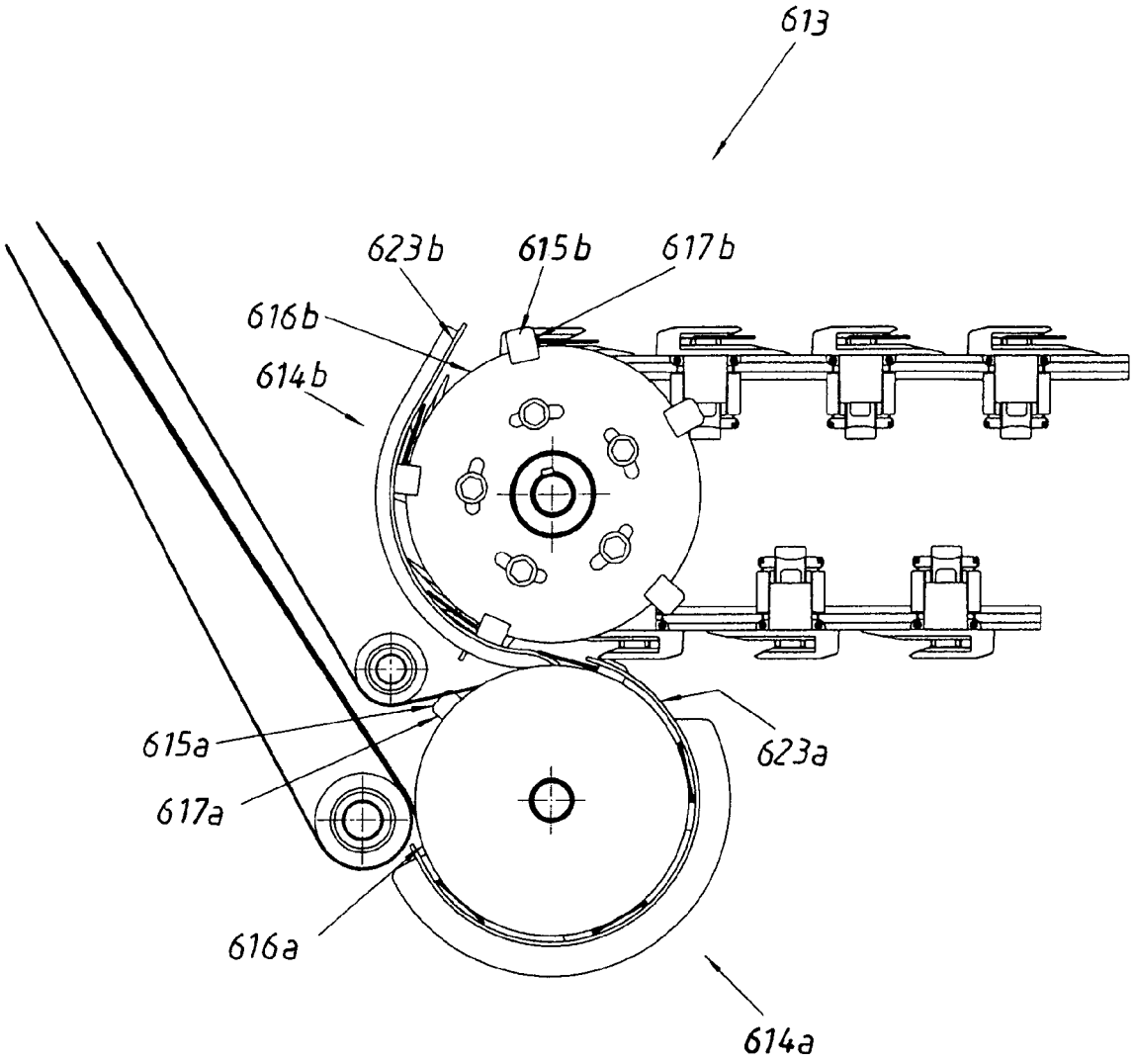

FIG. 6 shows another embodiment of the leaflet transferring device 613 which comprises two transferring wheels 614*a, b*. The two transferring wheels 614*a, b* have essentially the same characteristics as the devices described in FIGS. 2-4 and have carriers 615 which comprise bases 617 that are attached to a base surface 616 on the transferring wheels 614. The folded leaflets 603 are transported from the feed device 604 via the conveyor belt 605 to the first transferring wheel 614*a*. The leaflet 603 is conveyed on the first transferring wheel 614*a* by means of its carriers 615*a*. During the time that the carriers 615*a* convey the leaflet 603 around, the leaflet is straightened up along the bases 617*a* of the carriers. The straightened-up leaflet will then be delivered to the second transferring wheel 614*b* and conveyed by its carriers 615*b*. The leaflet transportation device 606 is synchronized with the second transferring wheel 614*b* in such a way that the leaflet holder 607, that is open, will be in line with the carriers 615*b*. The carriers 615*b* ensure that the leaflet lies in place by the leaflet making contact with the bases 617*b* of the carriers while it is being conveyed and the leaflet holder 607 can close and hold the leaflet 603 in the correct position. In this embodiment, it can also be seen that the transferring wheels 614*a, b* have been provided with cover plates 623*a, b* positioned at intervals along a line at right angles to the direction of transportation. The cover plates 623*a, b* are positioned in such a way that the carriers 615*a, b* can rotate around between the cover plates. This arrangement makes it possible for the cover plates 623*a, b* to be positioned closer to the base surfaces 616*a, b* and thereby ensures that the leaflet 603 lies closer to the base surface 616*a, b*.

The invention claimed is:

1. A device for a cartoning machine for transferring a leaflet from a first transportation device to a leaflet holder comprised in a second transportation device, the device comprising: a transferring device arranged to transfer the leaflet from the first transportation device to the second transportation device, the transferring device including a base surface and at least one carrier arranged to convey the leaflet and to place the leaflet in such a way that the leaflet is in contact with any one of the transferring device's carriers on both sides of a center line in relation to the extent of the leaflet in a direction at right angles to the direction of transportation during conveying of the leaflet, the transferring device being arranged to align and place the leaflet in a position such that the leaflet holder can take hold of the leaflet while the leaflet is being conveyed by the transferring device.

2. The device according to claim 1, wherein the carriers consist of profiles that have a base attached to the transferring device and that project from the base surface of the transferring device.

3. The device according to claim 2, wherein the profile of the carriers has a base that projects essentially at right angles from the base surface of the transferring device and in that they are provided with a lug projecting essentially at right angles from the base in the direction of transportation.

4. The device according to claim 2, wherein the profile of the carriers has a base that projects from the base surface of the transferring device, with an acute angle between the base of the profile and the base surface of the transferring device in the direction of transportation.

5. The device according to claim 2, wherein the transferring device is at least partially provided with an outer casing lying close to the distal end of the profile or the base or positioned between the bases of the carriers.

6. The device according to claim 2, wherein the base of one or more carriers is positioned on the transferring device in such a way that the single base or several bases form a straight line at right angles to the direction of transportation.

7. The device according to claim 6, wherein the transferring device includes a plurality of carriers positioned on the transferring device in such a way that the bases of the carriers form a plurality of straight lines at right angles to the direction of transportation.

8. The device according to claim 7, wherein the straight lines that are formed by the bases of the carriers and that are at right angles to the direction of transportation are spaced equidistantly.

9. The device according to claim 1, wherein the average speed of the second transportation device is the same as that of the transferring device.

10. The device according to claim 9, wherein the speeds of the second transportation device and of the transferring device are constant.

11. The device according to claim 9, wherein at least one of the second transportation device and the transferring device is driven at varying speeds by a servo motor.

12. The device according to claim 1, wherein the transferring device consists of a rotating body arranged to rotate in a direction parallel to the direction of transportation of the second transportation device.

13. The device according to claim 12, characterized in that the rotating body consists of a body with a cylindrical outer contour with a circular periphery.

14. The device according to claim 12 wherein the second transportation device has an axis of rotation for a control wheel comprised therein that is common with the center of rotation for the rotating body that constitutes the transferring device.

15. The device according to claim 1, wherein the transferring device includes an endless belt.

16. The device according to claim 1, wherein the transferring device comprises two transferring units.

17. A method for transferring a leaflet in a cartoning machine from a first transportation device to a leaflet holder comprised in a second transportation device, which method comprises:

transporting the leaflet in the first transportation device, delivering the leaflet from the first transportation device to a transferring device whereupon the transferring device conveys the leaflet by a plurality of carriers that are on the transferring device, which carriers are arranged to be in contact with the leaflet on both sides of a center line in relation to the breadth of the leaflet in a direction at right angles to the direction of transportation and, for the time that the leaflet is conveyed by the said carriers, enables the leaflet holder to take hold of the leaflet.

18. The method according to claim 17, wherein the average speeds of the second transportation device and the transferring device are the same.

19. The method according to claim 18, wherein the speeds of the second transportation device and the transferring device are the same.

20. The method according to claim 18, wherein the second transportation device and/or the transferring device are driven at varying speeds.

21. The method according to claim 17, while the leaflet is being conveyed in the transferring unit, resting the leaflet against the base surface of the transferring unit and can slide against the base surface so that the leaflet can align itself in relation to the carriers by making contact with these.

22. The method according to claim 17, wherein delivering includes transferring the leaflet from the first transportation device to a first transferring unit in the transferring device in which the leaflet is straightened up by the first transferring unit's carriers and is then delivered to the second transferring unit that is synchronized with the leaflet transportation device in such a way that its carriers are essentially in line with a leaflet holder, conveying the leaflet by the carriers and ensuring that the leaflet is in place and that the leaflet holder can close and hold the leaflet in the correct position.

* * * * *